US009328403B2

(12) United States Patent
Semba et al.

(10) Patent No.: US 9,328,403 B2
(45) Date of Patent: May 3, 2016

(54) NI-BASED HEAT RESISTANT ALLOY

(75) Inventors: Hiroyuki Semba, Sanda (JP); Hirokazu Okada, Kobe (JP); Hiroyuki Hirata, Neyagawa (JP); Mitsuru Yoshizawa, Amagasaki (JP); Atsuro Iseda, Kobe (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 14 days.

(21) Appl. No.: 14/237,586

(22) PCT Filed: Jul. 31, 2012

(86) PCT No.: PCT/JP2012/069382

§ 371 (c)(1),
(2), (4) Date: May 12, 2014

(87) PCT Pub. No.: WO2013/021853

PCT Pub. Date: Feb. 14, 2013

(65) Prior Publication Data

US 2014/0234155 A1 Aug. 21, 2014

(30) Foreign Application Priority Data

Aug. 9, 2011 (JP) ..... 2011-173504

(51) Int. Cl.
*C22C 19/05* (2006.01)
*C22F 1/10* (2006.01)

(52) U.S. Cl.
CPC ..... *C22C 19/056* (2013.01); *C22C 19/055* (2013.01); *C22F 1/10* (2013.01); *C22C 19/05* (2013.01); *C22C 19/051* (2013.01)

(58) Field of Classification Search
CPC ..... C22C 1/0433; C22C 19/00; C22C 19/03; C22C 19/05; C22C 19/051; C22C 19/055
USPC ..... 420/441–460
See application file for complete search history.

(56) References Cited

U.S. PATENT DOCUMENTS

| | | | | |
|---|---|---|---|---|
| 4,750,954 | A * | 6/1988 | Smith, Jr. | C22C 19/053 148/428 |
| 5,882,586 | A | 3/1999 | Tamura et al. | |
| 6,458,318 | B1 * | 10/2002 | Nishiyama | C22C 19/055 148/428 |
| 2008/0279716 | A1 | 11/2008 | Nishiyama et al. | |

FOREIGN PATENT DOCUMENTS

| | | |
|---|---|---|
| EP | 0 260 600 | 3/1988 |
| EP | 1 065 290 | 1/2001 |
| EP | 1 338 663 | 8/2003 |
| JP | 51-62126 | 5/1976 |
| JP | 51-84726 | 7/1976 |
| JP | 51-84727 | 7/1976 |
| JP | 53-35620 | 4/1978 |
| JP | 07-150277 | 6/1995 |
| JP | 07-216511 | 8/1995 |
| JP | 08-127848 | 5/1996 |
| JP | 08-218140 | 8/1996 |
| JP | 09-157779 | 6/1997 |
| JP | 2002-518599 | 6/2002 |
| JP | 2010-150593 | 7/2010 |
| JP | 2011-63838 | 3/2011 |
| JP | 4697357 | 6/2011 |
| RU | 2224809 | 2/2004 |
| WO | 2009/023090 | 2/2009 |
| WO | 2010/038826 | 4/2010 |
| WO | 2011/071054 | 6/2011 |

* cited by examiner

*Primary Examiner* — Roy King
*Assistant Examiner* — Jophy S Koshy
(74) *Attorney, Agent, or Firm* — Clark & Brody

(57) ABSTRACT

A Ni-based heat resistant alloy as pipe, plate, rod, forgings and the like consists of C≤0.15%, Si≤2%, Mn≤3%, P≤0.03%, S≤0.01%, Cr: 15% or more and less than 28%, Mo: 3 to 15%, Co: more than 5% and not more than 25%, Al: 0.2 to 2%, Ti: 0.2% to 3%, Nd: fn to 0.08%, and O≤0.4Nd, further containing, as necessary, at least one kind of Nb, W, B, Zr, Hf, Mg, Ca, Y, La, Ce, Ta, Re and Fe of specific amounts, the balance being Ni and impurities, wherein, $fn=1.7\times10^{-5}d+0.05\{(Al/26.98)+(Ti/47.88)+(Nb/92.91)\}$. In the formula, d denotes an average grain size (μm), and each element symbol denotes the content (mass %) of that element. If the alloy contains W, Mo+(W/2)≤15% holds. The alloy has improved ductility after long-term use at high temperatures, and cracking due to welding can be avoided.

4 Claims, No Drawings

NI-BASED HEAT RESISTANT ALLOY

TECHNICAL FIELD

The present invention relates to a Ni-based heat resistant alloy. More particularly, the invention relates to a high-strength Ni-based heat resistant alloy excellent in hot workability and in toughness and ductility after long-term use, which is used as a pipe material, a thick plate for parts having heat resistance and pressure resistance, a rod material, a forging, and the like in power generating boilers, chemical industry plants, and the like.

BACKGROUND ART

In recent years, a number of ultra super critical boilers which are operated at an increased temperature and pressure to achieve high efficiency are newly constructed in the world.

Specifically, in some projects, the steam temperature, which has so far been about 600° C., is further increased to 650° C. or higher and further to 700° C. or higher. This is based on the fact that energy saving, effective use of resources, and reduction in $CO_2$ gas emission for environmental preservation are challenges to solve energy problems, and are included in important industrial policies. In the case of power generating boilers burning a fossil fuel and reactors for the chemical industry, a highly efficient ultra super critical boilers and reactors are advantageous.

Such high temperature and pressure of steam also increases the temperature of a superheater tube of boiler, a reactor tube for the chemical industry, and a thick plate and a forging used as a part having heat resistance and pressure resistance to 700° C. or higher at the time of actual operation. Therefore, an alloy used in a harsh environment for a long period of time must be of excellent in not only high-temperature strength and high-temperature corrosion resistance but also long-term stability of metal micro-structure, creep rupture ductility, and creep fatigue resistance.

Further, during the maintenance work such as repair after long-term use, a material aged in a long period of time needs to be cut, worked, or welded, and therefore, not only the characteristics for a new material but also the soundness of an aged material have been required strongly in recent years.

In meeting the severe requirements, an Fe-based alloy such as an austenitic stainless steel suffers lack of creep rupture strength. Therefore, it is inevitable to use a Ni-based alloy in which the precipitation of a γ' phase or the like is utilized.

Accordingly, Patent Documents 1 to 8 disclose Ni-based alloys that contain Mo and/or W to achieve solid-solution strengthening, and contain Al and Ti to utilize precipitation strengthening of the γ' phase, which is an intermetallic compound, or specifically utilize precipitation strengthening of $Ni_3(Al,Ti)$ for use in the above-described harsh high-temperature environment.

In the alloys disclosed in Patent Documents 4 to 6, since 28% or more of Cr is contained, an a large amount of α-Cr phase having a bcc structure also precipitates and contributes to strengthening.

CITATION LIST

Patent Document

[Patent Document 1] JP51-84726A
[Patent Document 2] JP51-84727A
[Patent Document 3] JP7-150277A
[Patent Document 4] JP7-216511A

[Patent Document 5] JP8-127848A
[Patent Document 6] JP8-218140A
[Patent Document 7] JP9-157779A
[Patent Document 8] JP2002-518599A

SUMMARY OF INVENTION

Technical Problem

The Ni-based alloys disclosed in Patent Documents 1 to 8 have ductility lower than that of the conventional austenitic steel because the γ' phase precipitates or the γ' phase and the α-Cr phase precipitate, and may experience changes over time especially when being used for a long period of time, so that the ductility and toughness thereof decrease greatly as compared with a new material.

In the periodic inspection after the long-term use and the maintenance work performed on account of an accident or a trouble during the use, a defective material must be cut out partially and be replaced with a new material, and in this case, the new material must be welded to the aged material to be used continuously. Also, depending on the situation, partial bending work must be performed.

However, Patent Documents 1 to 8 do not disclose countermeasures for restraining the deterioration in material caused by the long-term use. That is, in Patent Documents 1 to 8, no studies are conducted on how the long-term aging is restrained, and how a safe and reliable material is ensured in a present large plant used in a high-temperature and pressure environment that the past plant did not have.

The present invention has been made in view of the circumstances, and accordingly an objective thereof is to provide a Ni-based heat resistant alloy in which the creep rupture strength is improved by the solid-solution strengthening and the precipitation strengthening of γ' phase, the dramatic improvement in ductility after long-term use at high temperatures is achieved, and the SR cracks that pose a problem in repair welding and the like can be avoided.

Solution to Problem

The present inventors examined the improvement in ductility after long-term use at high temperatures and the prevention of SR cracks of a Ni-based alloy using the precipitation strengthening of the γ' phase (hereinafter, referred to as a "γ' strengthening Ni-based alloy"). As a result, the present inventors obtained an important finding of the following item (a).

(a) In order to improve the ductility after long-term use at high temperatures and to prevent the SR cracks of the γ' strengthening Ni-based alloy, it is effective to contain Nd.

As a result of various examinations made further, the present inventors obtained findings of the following items (b) to (e).

(b) The average grain size and the degree of strengthening within the grain are important indexes of the improvement in ductility and the prevention of SR cracks.

(c) The degree of strengthening within the grain can be quantified by the amounts of Al, Ti and Nb which are γ' phase stabilizing elements, and form the γ' phase together with Ni.

(d) According to the average grain size and the degree of strengthening within the grain, the minimum necessary amount of Nd to be contained for the improvement in ductility and the prevention of SR cracks varies.

(e) In order to ensure the Nd amount effective in contributing to the improvement in ductility and the prevention of SR cracks, the content of oxygen must be regulated strictly according to the content of Nd.

The present invention was completed on the basis of the above-described findings, and the gist thereof is Ni-based heat resistant alloys described in the following items (1) to (3).

(1) A Ni-based heat resistant alloy consisting, in mass percent, of C: 0.15% or less, Si: 2% or less, Mn: 3% or less, P: 0.03% or less, S: 0.01% or less, Cr: 15% or more and less than 28%, Mo: 3 to 15%, Co: more than 5% and not more than 25%, Al: 0.2 to 2%, Ti: 0.2 to 3%, Nd: f1 to 0.08%, and O: 0.4Nd or less, the balance being Ni and impurities, wherein the f1 refers to the following formula, and in the formula, d denotes an average grain size (μm), and each symbol of an element denotes the content (mass %) of that element, and likewise, Nd in 0.4Nd denotes the content (mass %) of Nd.

$$f1=1.7\times10^{-5}d+0.05\{(Al/26.98)+(Ti/47.88)\}$$

(2) A Ni-based heat resistant alloy consisting, in mass percent, of C: 0.15% or less, Si: 2% or less, Mn: 3% or less, P: 0.03% or less, S: 0.01% or less, Cr: 15% or more and less than 28%, Mo: 3 to 15%, Co: more than 5% and not more than 25%, Al: 0.2 to 2%, Ti: 0.2 to 3%, Nd: f2 to 0.08%, and O: 0.4Nd or less, further containing at least one kind of Nb: 3.0% or less and W: less than 4% (however, Mo+(W/2): 15% or less), the balance being Ni and impurities, wherein the f2 refers to the following formula, and in the formula, d denotes an average grain size (μm), and each symbol of an element denotes the content (mass %) of that element, and likewise, each symbol of an element in 0.4Nd and Mo+(W/2) also denotes the content (mass %) of that element.

$$f2=1.7\times10^{-5}d+0.05\{(Al/26.98)+(Ti/47.88)+(Nb/92.91)\}$$

(3) The Ni-based heat resistant alloy described in the above item (1) or (2), wherein the alloy contains one or more kinds of elements selected from the following groups <1> to <4> instead of part of Ni:

<1> B: 0.01% or less, Zr: 0.2% or less, and Hf: 1% or less

<2> Mg: 0.05% or less, Ca: 0.05% or less, Y: 0.5% or less, La: 0.5% or less, and Ce: 0.5% or less <3> Ta: 8% or less, and Re: 8% or less <4> Fe: 15% or less.

The "impurities" in the "Ni and impurities" of the balance means impurities mixed from ore and scrap used as a raw material, a manufacturing environment, and the like when the heat resistant alloy is manufactured on an industry basis.

Advantageous Effects of Invention

The Ni-based heat resistant alloy of the present invention is an alloy in which the dramatic improvement in ductility after long-term use at high temperatures is achieved, and further the SR cracks that pose a problem in repair welding and the like can be avoided. Therefore, this Ni-based heat resistant alloy can be used suitably as a pipe material, a thick plate for parts having heat resistance and pressure resistance, a rod material, a forging, and the like in power generating boilers, chemical industry plants, and the like.

DESCRIPTION OF EMBODIMENTS

The reason for restricting the chemical composition of the Ni-based heat resistant alloy in the present invention is as described below. In the following description, "%" representing the content of each element means "mass %."

C: 0.15% or Less

C (carbon) is an element effective in securing tensile strength and creep strength, by forming carbides, which are necessary when the material is used in a high-temperature environment, and therefore is contained appropriately in the present invention. However, if the C content exceeds 0.15%, the amount of carbides that do not form a solid solution in a solution state increases, so that not only C does not contribute to the improvement in high-temperature strength but also C deteriorates the mechanical properties such as toughness and the weldability. Therefore, the C content was set to 0.15% or less. The C content is preferably 0.1% or less.

In order to achieve the effect of C, the lower limit of C content is preferably 0.005%, and further preferably 0.01%. The lower limit of C content is still further preferably 0.02%.

Si: 2% or Less

Si (silicon) is added as a deoxidizing element. If the Si content exceeds 2%, the weldability and hot workability are decreased. Also, the production of an intermetallic compound phase such as a σ phase and the like is promoted, so that the toughness and ductility decrease due to deterioration of the structural stability at high temperatures. Therefore, the Si content was set to 2% or less. The Si content is preferably 1.0% or less, further preferably 0.8% or less.

In order to achieve the effect of Si, the lower limit of Si content is preferably 0.05%, further preferably 0.1%.

Mn: 3% or Less

Mn (manganese) has a deoxidizing function like Si, and also has an effect of improving the hot workability by fixing S, which is contained as an impurity in the alloy, as a sulfide. However, if the Mn content increases, the formation of a spinel type oxide film is promoted, and the oxidation resistance at high temperatures is deteriorated. Therefore, the Mn content is 3% or less. The Mn content is preferably 2.0% or less, further preferably 1.0% or less.

In order to achieve the effect of Mn, the lower limit of the Mn content is preferably set to 0.05%, and more preferably set to 0.08%. The further preferable lower limit of the Mn is 0.1%.

P: 0.03% or Less

P (phosphorus) is contained in the alloy as an impurity, and remarkably decreases the weldability and hot workability if being contained in large amounts. Therefore, the P content was set to 0.03% or less. The P content should be made as low as possible, and is preferably 0.02% or less, further preferably 0.015% or less.

S: 0.01% or Less

S (sulfur) is, like phosphorus, contained in the alloy as an impurity, and remarkably decreases the weldability and hot workability if being contained in large amounts. Therefore, the S content was set to 0.01% or less.

The S content in the case where importance is attached to the hot workability is preferably 0.005% or less, further preferably 0.003% or less.

Cr: Not Less than 15% and Less than 28%

Cr (chromium) is an important element for achieving an effect excellent in improving corrosion resistance such as oxidation resistance, steam oxidation resistance, and high-temperature corrosion resistance. However, if the Cr content is less than 15%, the desired effect cannot be achieved. On the other hand, if the Cr content exceeds 28%, the micro-structure is unstabilized on account of the deterioration in hot workability, the precipitation of σ phase, and the like. Therefore, the Cr content was set to 15% or more and less than 28%. The lower limit of the Cr content is preferably 18%. Also, the upper limit of the Cr content is preferably 26%, further preferably 25%.

Mo: 3 to 15%

Mo (molybdenum) dissolves in the parent phase and has effects of improving the creep rupture strength and decreasing the linear expansion coefficient. In order to achieve these effects, 3% or more of Mo must be contained. However, if the Mo content exceeds 15%, the hot workability and structural stability decrease. Therefore, the Mo content is set to 3 to 15%.

In addition to Mo of the above-described content range, the later-described amount of W may be contained. In this case, however, the Mo content must be such that the sum of the Mo content and a half of the W content, that is, [Mo+(W/2)] is 15% or less.

The preferable lower limit of the Mo content is 4%, and the preferable upper limit thereof is 14%. The further preferable lower limit of the Mo content is 5%, and the further preferable upper limit thereof is 13%.

Co: More than 5% and not More than 25%

Co (cobalt) dissolves in the parent phase, and improves the creep rupture strength. Further, Co also has an effect of further improving the creep rupture strength by increasing the precipitation amount of γ' phase especially in the temperature range of 750° C. or higher. In order to achieve these effects, an amount more than 5% of Co must be contained. However, if the Co content exceeds 25%, the hot workability decreases. Therefore, the Co content is set to more than 5% and not more than 25%.

In the case where importance is attached to the balance between hot workability and creep rupture strength, the preferable lower limit of the Co content is 7%, and the preferable upper limit thereof is 23%. The further preferable lower limit of the Co content is 10%, and the further preferable upper limit thereof is 22%.

In the case where importance is attached to the creep rupture strength especially in the temperature range of 750° C. or higher, 17% or more of Co is preferably contained, and it is further preferable that more than 20% of cobalt be contained.

Al: 0.2 to 2%

Al (aluminum) is an important element in the Ni-based alloy, which precipitates the γ' phase ($Ni_3Al$), an intermetallic compound, and improves the creep rupture strength remarkably. In order to achieve this effect, 0.2% or more of Al must be contained. However, if the Al content exceeds 2%, the hot workability is decreased, and hot forging and hot pipe-making become difficult to do. Therefore, the Al content was set to 0.2 to 2% or less. The preferable lower limit of the Al content is 0.8%, and the preferable upper limit thereof is 1.8%. The more preferable lower limit of the Al content is 0.9%, and the more preferable upper limit thereof is 1.7%.

Ti: 0.2 to 3%

Ti (titanium) is an important element in the Ni-based alloy, which forms the γ' phase ($Ni_3(Al,Ti)$), which is an intermetallic compound, together with Al, and improves the creep rupture strength remarkably. To achieve this effect, 0.2% or more of titanium must be contained. However, if the Ti content exceeds 3%, the hot workability is decreased, and hot forging and hot pipe-making become difficult to do. Therefore, the Ti content was set to 0.2 to 3%. The preferable lower limit of the Ti content is 0.3%, and the preferable upper limit thereof is 2.8%. The more preferable lower limit of the Ti content is 0.4%, and the more preferable upper limit thereof is 2.6%.

Nd: F1 to 0.08% (when Nb is not Contained) or f2 to 0.08% (when Nb is Contained)

Nd (neodymium) is an important element characterizing the Ni-based heat resistant alloy in accordance with the present invention. That is, Nd is an important element that is very effective in improving the ductility after long-term use at high temperatures and preventing the SR cracks of the γ' strengthening Ni-based alloy. In order to achieve these effects, Nd of an amount of f1 or larger, f1 represented by a formula described below of the average grain size d (μm) and the contents (mass %) of Al and Ti, must be contained in the case where the Ni-based heat resistant alloy does not contain Nb, and also Nd of an amount of f2 or larger, f2 represented by a formula described below of the average grain size d (μm) and the contents (mass %) of Al, Ti, and Nb, must be contained in the case where the Ni-based heat resistant alloy contains Nb.

$$f1=1.7\times10^{-5}d+0.05\{(Al/26.98)+(Ti/47.88)\}$$

$$f2=1.7\times10^{-5}d+0.05\{(Al/26.98)+(Ti/47.88)+(Nb/92.91)\}$$

The improvement in ductility and the prevention of SR cracks are also affected by the average grain size and the degree of strengthening within the grain. The degree of strengthening within the grain is affected by the amounts of Al, Ti and Nb which are γ' phase stabilizing elements, and form the γ' phase together with Ni. Therefore, the minimum necessary amount of Nd to be contained for the improvement in ductility and the prevention of SR cracks varies according to the average grain size and the degree of strengthening within the grain.

On the other hand, if the Nd content is excessive and exceeds 0.08%, the hot workability decreases, and the ductility decreases on account of inclusions. Therefore, the Nd content was set to f1 to 0.08% (when Nb is not contained) or f2 to 0.08% (when Nb is contained).

Generally, Nd is also contained in a mischmetal. Therefore, Nd of the above-described amount may be contained by being added in a form of mischmetal.

O: 0.4Nd or Less

O (oxygen) is contained in the alloy as an impurity, and decreases the hot workability and ductility. Moreover, in the case of the present invention in which Nd is contained, O combines easily with Nd to form oxides, and undesirably reduces the above-described function of improving the ductility after long-term use at high temperatures and preventing the SR cracks of Nd. Therefore, an upper limit is placed on the O content, and the O content was set to 0.4Nd or less, that is, 0.4 times or less of the Nd content. The O content is preferably made as low as possible.

One of the Ni-based heat resistant alloys of the present invention consists of the above-described elements of C through O, the balance being Ni and impurities.

Hereunder, Ni in the balance of the Ni-based heat resistant alloy of the present invention is explained.

Ni (nickel) is an element for stabilizing the austenitic structure, and is an element important for securing corrosion resistance as well. In the present invention, the Ni content need not be defined especially, and is made a content obtained by removing the content of impurities from the balance. However, the Ni content in the balance preferably exceeds 50%, and further preferably exceeds 60%.

As described already, the "impurities" means impurities mixed from ore and scrap used as a raw material, a manufacturing environment, and the like when the heat resistant alloy is manufactured on an industry basis.

Another of the Ni-based heat resistant alloys of the present invention further contains one or more kinds of elements selected from Nb, W, B, Zr, Hf, Mg, Ca, Y, La, Ce, Ta, Re and Fe in addition to the above-described elements.

Hereunder, the operational advantages of these optional elements and the reasons for limiting the contents thereof are explained.

Both Nb and W have a function of improving the creep strength. Therefore, these elements may be contained.

Nb: 3.0% or Less

Nb (niobium) has a function of improving the creep strength. That is, Nb forms the γ' phase, which is an intermetallic compound, together with Al and Ti, and has a function of improving the creep strength. Therefore, niobium may be contained. However, if the Nb content increases and exceeds 3.0%, the hot workability and toughness are decreased. Therefore, the content of Nb at the time of being contained was set to 3.0% or less. The content of Nb at the time of being contained is preferably 2.5% or less.

On the other hand, in order to achieve the effect of Nb, the Nb content is preferably 0.05% or more, further preferably 0.1% or more.

W: Less than 4% (However, Mo+(W/2): 15% or Less)

W (tungsten) has a function of improving the creep strength. That is, W dissolves in the parent phase, and has a function of improving the creep strength as a solid-solution strengthening element. Therefore, W may be contained. However, if the W content increases to 4% or more, the hot workability decreases. Further, in the present invention, Mo is contained. If Mo and W are contained compositely in an amount such that the sum of the Mo content and a half of the W content, that is, [Mo+(W/2)] is more than 15%, the hot workability decreases greatly. Therefore, the content of W at the time of being contained was set to less than 4%, and further was set so that [Mo+(W/2)] is 15% or less. The content of tungsten at the time of being contained is preferably 3.5% or less.

On the other hand, in order to stably achieve the effect of W, the W content is preferably 1% or more, further preferably 1.5% or more.

The above-described Nb and W can be contained in only either one kind or compositely in two kinds. The total amount of these elements contained compositely is preferably 6% or less.

Any of B, Zr and Hf belonging to the group of <1> has a function of improving the creep strength. Therefore, these elements may be contained.

B: 0.01% or Less

B (boron) has a function of improving the creep strength. B also has a function of improving the high temperature strength. That is, B exists at grain boundaries as a simple substance, and has a function of restraining grain boundary sliding caused by grain boundary strengthening during the use at high temperatures. Further, B exists in carbo-nitrides together with C and N, and has a function of improving the creep strength by accelerating fine dispersion precipitation of carbo-nitrides, and also has a function of improving the high temperature strength. Therefore, B may be contained. However, if the B content increases and exceeds 0.01%, the weldability deteriorates. Therefore, the content of B at the time of being contained was set to 0.01% or less. The upper limit of content of B at the time of being contained is preferably 0.008%, further preferably 0.006%.

On the other hand, in order to stably achieve the effect of B, the lower limit of the B content is preferably 0.0005%, and further preferably 0.001%.

Zr: 0.2% or Less

Zr (zirconium) is a grain boundary strengthening element, and has a function of improving the creep strength. Zr also has a function of improving the rupture ductility. Therefore, Zr may be contained. However, if the Zr content increases and exceeds 0.2%, the hot workability is decreased. Therefore, the content of Zr at the time of being contained was set to 0.2% or less. The content of Zr at the time of being contained is preferably 0.1% or less, further preferably 0.05% or less.

On the other hand, in order to stably achieve the effects of Zr, the Zr content is preferably 0.005% or more, and further preferably 0.01% or more.

Hf: 1% or Less

Hf (hafnium) contributes mainly to the grain boundary strengthening, and has a function of improving the creep strength. Therefore, Hf may be contained. However, if the Hf content exceeds 1%, the workability and weldability are impaired. Therefore, the content of Hf at the time of being contained was set to 1% or less. The content of Hf at the time of being contained is preferably 0.8% or less, further preferably 0.5% or less.

On the other hand, in order to stably achieve the effect of Hf, the Hf content is preferably 0.005% or more, and further preferably 0.01% or more. The Hf content is still further preferably 0.02% or more.

The above-described B, Zr and Hf can be contained in only either one kind or compositely in two or more kinds. The total amount of these elements contained compositely is preferably 0.8% or less.

Any of Mg, Ca, Y, La and Ce belonging to the group of <2> immobilizes S as a sulfide, and has a function of improving the hot workability. Therefore, these elements may be contained.

Mg: 0.05% or Less

Mg (magnesium) fixes S, which hinders the hot workability, as a sulfide, and has a function of improving the hot workability. Therefore, Mg may be contained. However, if the Mg content exceeds 0.05%, the cleanliness is impaired, and the hot workability and ductility are rather impaired. Therefore, the content of Mg at the time of being contained was set to 0.05% or less. The content of Mg at the time of being contained is preferably 0.02% or less, further preferably 0.01% or less.

On the other hand, in order to stably achieve the effect of Mg, the Mg content is preferably 0.0005% or more, and further preferably 0.001% or more.

Ca: 0.05% or Less

Ca (calcium) fixes S, which hinders the hot workability, as a sulfide, and has a function of improving the hot workability. Therefore, Ca may be contained. However, if the Ca content exceeds 0.05%, the cleanliness is impaired, and the hot workability and ductility are rather impaired. Therefore, the content of Ca at the time of being contained was set to 0.05% or less. The content of Ca at the time of being contained is preferably 0.02% or less, further preferably 0.01% or less.

On the other hand, in order to stably achieve the effect of Ca, the Ca content is preferably 0.0005% or more, and further preferably 0.001% or more.

Y: 0.5% or Less

Y (yttrium) fixes S as a sulfide, and has a function of improving the hot workability. Also, Y has a function of improving the adhesion of $Cr_2O_3$ protective film on the surface of alloy, and especially has a function of improving the oxidation resistance at the time of repeated oxidation. Further, Y contributes to the grain boundary strengthening, and also has a function of improving the creep strength and creep rupture ductility. Therefore, Y may be contained. However, if the Y content increases and exceeds 0.5%, inclusions such as oxides increase in amount, and therefore the workability and weldability are impaired. Therefore, the content of Y at the time of being contained was set to 0.5% or less. The content of Y at the time of being contained is preferably 0.3% or less, further preferably 0.15% or less.

On the other hand, in order to stably achieve the effects of Y, the Y content is preferably 0.0005% or more, further preferably 0.001% or more. The Y content is still further preferably 0.002% or more.

La: 0.5% or Less

La (lanthanum) fixes S as a sulfide, and has a function of improving the hot workability. Also, La has a function of improving the adhesion of $Cr_2O_3$ protective film on the surface of alloy, and especially has a function of improving the oxidation resistance at the time of repeated oxidation. Further, La contributes to the grain boundary strengthening, and also has a function of improving the creep strength and creep rupture ductility. Therefore, La may be contained. However, if the La content exceeds 0.5%, inclusions such as oxides increase in amount, and therefore the workability and weldability are impaired. Therefore, the content of La at the time of being contained was set to 0.5% or less. The content of La at the time of being contained is preferably 0.3% or less, further preferably 0.15% or less.

On the other hand, in order to stably achieve the effects of La, the La content is preferably 0.0005% or more, further preferably 0.001% or more. The La content is still further preferably 0.002% or more.

Ce: 0.5% or Less

Ce (cerium) fixes S as a sulfide, and has a function of improving the hot workability. Also, Ce has a function of improving the adhesion of $Cr_2O_3$ protective film on the surface of alloy, and especially has a function of improving the oxidation resistance at the time of repeated oxidation. Further, Ce contributes to the grain boundary strengthening, and also has a function of improving the creep rupture strength and creep rupture ductility. Therefore, Ce may be contained. However, if the Ce content increases and exceeds 0.5%, inclusions such as oxides increase in amount, and therefore the workability and weldability are impaired. Therefore, the content of Ce at the time of being contained was set to 0.5% or less. The content of Ce at the time of being contained is preferably 0.3% or less, further preferably 0.15% or less.

On the other hand, in order to stably achieve the effects of Ce, the Ce content is preferably 0.0005% or more, further preferably 0.001% or more. The La content is still further preferably 0.002% or more.

The above-described Mg, Ca, Y, La and Ce can be contained in only either one kind or compositely in two or more kinds. The total amount of these elements contained compositely is preferably 0.5% or less.

Both Ta and Re of a <3> group have a function of improving the high-temperature strength and creep strength as solid-solution strengthening elements. Therefore, these elements may be contained.

Ta: 8% or Less

Ta (tantalum) forms carbo-nitrides, and has a function of improving the high-temperature strength and creep strength as a solid-solution strengthening element. Therefore, Ta may be contained. However, if the Ta content exceeds 8%, the workability and mechanical properties are impaired. Therefore, the content of Ta at the time of being contained was set to 8% or less. The content of Ta at the time of being contained is preferably 7% or less, further preferably 6% or less.

On the other hand, in order to stably achieve the effect of Ta, the Ta content is preferably 0.01% or more, further preferably 0.1% or more. The Ta content is still further preferably 0.5% or more.

Re: 8% or Less

Re (rhenium) has a function of improving the high-temperature strength and creep strength mainly as a solid-solution strengthening element. Therefore, Re may be contained. However, if the Re content increases and exceeds 8%, the workability and mechanical properties are impaired. Therefore, the content of Re at the time of being contained was set to 8% or less. The content of Re at the time of being contained is preferably 7% or less, further preferably 6% or less.

On the other hand, in order to stably achieve the effect of Re, the Re content is preferably 0.01% or more, further preferably 0.1% or more. The Re content is still further preferably 0.5% or more.

The above-described Ta and Re can be contained in only either one kind or compositely in two kinds. The total amount of these elements contained compositely is preferably 8% or less.

Fe: 15% or Less

Fe (iron) has a function of improving the hot workability of Ni-based alloy. Therefore, Fe may be contained. In the actual manufacturing process, even if Fe is not contained, about 0.5 to 1% of Fe is sometimes contained as an impurity on account of contamination from a furnace wall caused by the melting of Fe-based alloy. In the case where Fe is contained, if the Fe content exceeds 15%, the oxidation resistance and structural stability deteriorate. Therefore, the Fe content is set to 15% or less. In the case where importance is attached to the oxidation resistance, the Fe content is preferably 10% or less.

In order to achieve the effect of Fe, the lower limit of the Fe content is preferably set to 1.5%, and further preferably set to 2.0%. The still further preferable lower limit of the Fe content is 2.5%.

Hereunder, the present invention is explained more specifically with reference to examples, however, the present invention is not limited to these examples.

Examples

Ni-based alloys 1 to 14 and A to G having chemical compositions shown in Table 1 were melted by using a high-frequency vacuum furnace to obtain 30-kg ingots.

TABLE 1

| | Chemical composition (mass %) Balance: Ni and impurities | | | | | | | | | | | | | | |
|---|---|---|---|---|---|---|---|---|---|---|---|---|---|---|---|
| Alloy | C | Si | Mn | P | S | Cr | Mo | Co | Al | Ti | Nd | D | Others | Mo + (W/2) | 0.4Nd |
| 1 | 0.055 | 0.16 | 0.18 | 0.004 | 0.001 | 22.04 | 6.37 | 6.27 | 1.08 | 0.50 | 0.021 | 0.004 | — | 6.37 | 0.008 |
| 2 | 0.061 | 0.18 | 0.15 | 0.005 | 0.001 | 21.85 | 9.11 | 11.93 | 1.23 | 0.44 | 0.025 | 0.005 | — | 9.11 | 0.010 |
| 3 | 0.052 | 0.25 | 0.22 | 0.004 | 0.001 | 21.97 | 12.41 | 15.21 | 1.44 | 1.15 | 0.008 | 0.001 | — | 12.41 | 0.003 |
| 4 | 0.059 | 0.19 | 0.17 | 0.005 | 0.001 | 22.10 | 9.54 | 24.12 | 1.28 | 0.51 | 0.014 | 0.003 | — | 9.54 | 0.006 |
| 5 | 0.057 | 0.19 | 0.20 | 0.007 | 0.001 | 21.76 | 9.51 | 12.04 | 1.17 | 0.47 | 0.015 | 0.002 | W: 3.31 | 11.17 | 0.006 |
| 6 | 0.060 | 0.18 | 0.17 | 0.005 | 0.002 | 25.31 | 8.59 | 8.91 | 0.98 | 1.28 | 0.048 | 0.009 | Nb: 2.24 | 8.59 | 0.019 |
| 7 | 0.058 | 0.08 | 0.07 | 0.003 | 0.001 | 19.85 | 6.13 | 21.16 | 0.57 | 2.14 | 0.031 | 0.007 | — | 6.13 | 0.012 |
| 8 | 0.064 | 0.17 | 0.18 | 0.004 | 0.001 | 22.05 | 9.17 | 12.10 | 1.14 | 0.51 | 0.028 | 0.007 | B: 0.0023 | 9.17 | 0.011 |
| 9 | 0.062 | 0.18 | 0.22 | 0.008 | 0.001 | 23.07 | 7.28 | 21.05 | 0.87 | 1.91 | 0.016 | 0.004 | Zr: 0.024, Hf: 0.25, | 7.28 | 0.006 |

TABLE 1-continued

| Alloy | Chemical composition (mass %) Balance: Ni and impurities | | | | | | | | | | | | | | |
|---|---|---|---|---|---|---|---|---|---|---|---|---|---|---|---|
| | C | Si | Mn | P | S | Cr | Mo | Co | Al | Ti | Nd | D | Others | Mo + (W/2) | 0.4Nd |
| 10 | 0.035 | 0.26 | 0.09 | 0.005 | 0.002 | 21.36 | 7.13 | 19.87 | 1.66 | 1.93 | 0.025 | 0.005 | W: 2.92 Mg: 0.0014, Ca: 0.0022, Fe: 2.54 | 7.13 | 0.010 |
| 11 | 0.071 | 0.15 | 0.24 | 0.009 | 0.002 | 22.45 | 9.85 | 12.30 | 1.26 | 0.71 | 0.009 | 0.002 | Y: 0.029, Ce: 0.027 | 9.85 | 0.004 |
| 12 | 0.055 | 0.12 | 0.20 | 0.006 | 0.002 | 20.74 | 6.88 | 19.27 | 0.67 | 2.12 | 0.010 | 0.003 | Zr: 0.21, La: 0.035 | 6.88 | 0.004 |
| 13 | 0.068 | 0.24 | 0.18 | 0.006 | 0.001 | 22.51 | 9.72 | 13.32 | 1.31 | 0.50 | 0.032 | 0.007 | Ta: 1.88 | 9.72 | 0.013 |
| 14 | 0.062 | 0.21 | 0.49 | 0.006 | 0.001 | 20.08 | 6.24 | 20.26 | 0.56 | 2.20 | 0.024 | 0.004 | Re: 2.92 | 6.24 | 0.010 |
| A | 0.063 | 0.17 | 0.13 | 0.004 | 0.001 | 21.90 | 9.18 | 12.02 | 1.19 | 0.48 | *— | 0.005 | — | 9.18 | — |
| B | 0.060 | 0.18 | 0.16 | 0.005 | 0.001 | 21.94 | 9.21 | 11.98 | 1.20 | 0.46 | 0.005 | 0.001 | — | 9.21 | 0.002 |
| C | 0.061 | 0.11 | 0.08 | 0.004 | 0.001 | 19.98 | 6.20 | 21.23 | 0.58 | 2.19 | 0.005 | 0.001 | — | 6.20 | 0.002 |
| D | 0.059 | 0.16 | 0.17 | 0.006 | 0.001 | 21.81 | 9.15 | 12.14 | 1.22 | 0.47 | *0.091 | 0.006 | — | 9.15 | 0.036 |
| E | 0.057 | 0.10 | 0.08 | 0.004 | 0.001 | 20.15 | 6.24 | 21.21 | 0.54 | 2.07 | *0.089 | 0.008 | — | 6.24 | 0.036 |
| F | 0.062 | 0.15 | 0.14 | 0.005 | 0.001 | 22.11 | 9.14 | 12.10 | 1.25 | 0.45 | 0.023 | *0.013 | — | 9.14 | 0.009 |
| G | 0.059 | 0.09 | 0.11 | 0.004 | 0.001 | 20.04 | 6.15 | 21.04 | 0.51 | 2.11 | 0.027 | *0.014 | — | 6.15 | 0.011 |

*mark denotes deviation from condition defined in the present invention.

The ingot obtained as described above was heated to 1160° C., and thereafter was hot forged into a 15 mm-thick plate material so that the finishing temperature was 1000° C.

Next, the 15 mm-thick plate material was subjected to softening heat treatment at 1100° C. and was cold-rolled to 10 mm, and further was held at 1180° C. for 30 minutes and thereafter was water cooled.

By using a part of the 10 mm-thick plate material, which had been held at 1180° C. for 30 minutes and had been water cooled, a test specimen, which had been cut and embedded in a resin so that the rolling longitudinal direction was an observation surface, was mirror polished, and thereafter was etched with mixed acid or a Kalling reagent, and optical microscope observation was made. In the optical microscope observation, photographing was performed at ×100 magnification in five visual fields, the average grain intercept length was measured by the cutting method in a total of four directions of each visual field, longitudinal (perpendicular to the rolling direction), transverse (parallel to the rolling direction), and diagonal line, and the average grain size d (μm) was determined by multiplying the average grain intercept length by a factor of 1.128.

By using the average grain size d (μm) determined as described above, $$f1=1.7\times10^{-5}d+0.05\{(Al/26.98)+(Ti/47.88)\}$$

or $$f2=1.7\times10^{-5}d+0.05\{(Al/26.98)+(Ti/47.88)+(Nb/92.91)\}$$

was calculated, and the relationship between the Nd content in each alloy and the lower limit value of Nd content defined in the present invention was examined.

For each alloy, Table 2 summarizedly gives the calculation result of f1 or f2 together with the average grain size d (μm). Further, Table 2 additionally gives the contents of Nd, Al, Ti and Nb given in Table 1.

TABLE 2

| Alloy | Average grain size d (μm) | Content of element (mass %) Al | Ti | Nb | f1 or f2 | Nd content (mass %) |
|---|---|---|---|---|---|---|
| 1 | 152 | 1.08 | 0.50 | — | 0.005 | 0.021 |
| 2 | 224 | 1.23 | 0.44 | — | 0.007 | 0.025 |
| 3 | 83 | 1.44 | 1.15 | — | 0.005 | 0.008 |

TABLE 2-continued

| Alloy | Average grain size d (μm) | Content of element (mass %) Al | Ti | Nb | f1 or f2 | Nd content (mass %) |
|---|---|---|---|---|---|---|
| 4 | 198 | 1.28 | 0.51 | — | 0.006 | 0.014 |
| 5 | 104 | 1.17 | 0.47 | — | 0.004 | 0.015 |
| 6 | 251 | 0.98 | 1.28 | 2.24 | 0.009 | 0.048 |
| 7 | 179 | 0.57 | 2.14 | — | 0.006 | 0.031 |
| 8 | 202 | 1.14 | 0.51 | — | 0.006 | 0.028 |
| 9 | 142 | 0.87 | 1.91 | — | 0.006 | 0.016 |
| 10 | 305 | 1.66 | 1.93 | — | 0.010 | 0.025 |
| 11 | 116 | 1.26 | 0.71 | — | 0.005 | 0.009 |
| 12 | 125 | 0.67 | 2.12 | — | 0.006 | 0.010 |
| 13 | 210 | 1.31 | 0.50 | — | 0.007 | 0.032 |
| 14 | 122 | 0.56 | 2.20 | — | 0.005 | 0.024 |
| A | 215 | 1.19 | 0.48 | — | 0.006 | *— |
| B | 230 | 1.20 | 0.46 | — | 0.007 | *0.005 |
| C | 188 | 0.58 | 2.19 | — | 0.007 | *0.005 |
| D | 219 | 1.22 | 0.47 | — | 0.006 | *0.091 |
| E | 181 | 0.54 | 2.07 | — | 0.006 | *0.089 |
| F | 210 | 1.25 | 0.45 | — | 0.006 | 0.023 |
| G | 178 | 0.51 | 2.11 | — | 0.006 | 0.027 |

$f1 = 1.7 \times 10^{-5}d + 0.05\{(Al/26.98) + (Ti/47.88)\}$ $f2 = 1.7 \times 10^{-5}d + 0.05\{(Al/26.98) + (Ti/47.88) + (Nb/92.91)\}$

*mark denotes deviation from condition defined in the present invention.

It was revealed from Table 2 that only the Nd contents of alloy B and alloy C were lower than the lower limit value of Nd content defined in the present invention.

Therefore, it was revealed that, of the alloys given in Table 1, a total of seven alloys, that is, the alloys B and C added to alloys A and D to G were alloys having the chemical composition deviating from the condition defined in the present invention.

On the other hand, it was revealed that alloys 1 to 14 were alloys having the chemical composition within the range defined in the present invention.

Next, By using a remaining part of the 10 mm-thick plate material, which had been held at 1180° C. for 30 minutes and had been water cooled, from a central portion in the thickness direction, a round-bar tensile test specimen having a diameter of 6 mm and a gage length of 30 mm was prepared, by machining, in parallel to the longitudinal direction, and a creep rupture test and a high-temperature tensile test at a very low strain rate were conducted by using this round-bar tensile test specimen.

The creep rupture test was conducted by applying an initial stress of 300 MPa to the round-bar tensile test specimen having the above-described shape at 700° C. to measure the rupture time and rupture elongation.

Further, by using the round-bar tensile test specimen having the above-described shape, the tensile test was conducted at 700° C. and at a very low strain rate of $10^{-6}$/s to measure the reduction of area at rupture.

The strain rate of $10^{-6}$/s is a very low strain rate such as to be 1/100 to 1/1000 of the strain rate in the usual high-temperature tensile test. Therefore, by measuring the reduction of area at rupture at the time when the tensile test is conducted at this very low strain rate, the relative evaluation of preventing SR crack susceptibility can be performed.

Specifically, in the case where the reduction of area at rupture at the time when the tensile test is conducted at the above-described very low strain rate is high, it can be evaluated that the preventing SR crack susceptibility is low, and the effect of preventing SR cracks is great.

Table 3 summarizes the test results.

TABLE 3

| | | Creep rupture test at 700° C. and 300 MPa | | Tensile test at 700° C. and | |
|---|---|---|---|---|---|
| Test No. | Alloy | Creep rupture time (h) | Creep rupture elongation (%) | at very low strain rate Reduction of area at rupture (%) | Remarks |
| 1 | 1 | 1180 | 31.4 | 37.2 | Example embodiment of the present invention |
| 2 | 2 | 1527 | 22.5 | 28.9 | |
| 3 | 3 | 1819 | 19.2 | 21.3 | |
| 4 | 4 | 1733 | 21.1 | 26.7 | |
| 5 | 5 | 1637 | 21.4 | 24.1 | |
| 6 | 6 | 1725 | 18.4 | 20.5 | |
| 7 | 7 | 3135 | 18.2 | 22.4 | |
| 8 | 8 | 1638 | 26.4 | 32.5 | |
| 9 | 9 | 3352 | 22.1 | 24.6 | |
| 10 | 10 | 3409 | 17.4 | 19.1 | |
| 11 | 11 | 1612 | 18.1 | 21.8 | |
| 12 | 12 | 3268 | 18.8 | 23.2 | |
| 13 | 13 | 2151 | 21.0 | 25.1 | |
| 14 | 14 | 3643 | 18.0 | 20.4 | |
| 15 | *A | 648 | 5.2 | 4.2 | Comparative example |
| 16 | *B | 684 | 7.0 | 5.8 | |
| 17 | *C | 1018 | 1.8 | 2.4 | |
| 18 | *D | 952 | 4.1 | 3.3 | |
| 19 | *E | 1055 | 4.3 | 3.1 | |
| 20 | *F | 720 | 7.3 | 6.8 | |
| 21 | *G | 1082 | 3.1 | 3.9 | |

*mark denotes deviation from condition defined in the present invention.

Table 3 reveals that in the case of test Nos. 1 to 14 of example embodiments of the present invention using alloys 1 to 14 having the chemical composition within the range defined in the present invention, all of the creep rupture time, the creep rupture ductility, and the reduction of area at rupture in the tensile test at very low strain rate (that is, effects of preventing SR cracks) are good.

In contrast, in the case of test Nos. 15 to 21 of comparative examples using alloys A to G having the chemical composition deviating from the condition defined in the present invention, as compared with the case of test Nos. 1 to 14 of example embodiments of the present invention, all of the creep rupture time, the creep rupture ductility, and the reduction of area at rupture in the tensile test at very low strain rate (that is, effects of preventing SR cracks) are poor.

That is, in the case of test Nos. 15, 16 and 18, although alloys A, B and D each have a chemical composition almost equivalent to that of alloy 2 used in test No. 2 except that Nd is not contained, or the Nd content is out of the range defined in the present invention, all of the creep rupture time, the creep rupture ductility, and the reduction of area at rupture in the tensile test at very low strain rate (that is, effects of preventing SR cracks) are poor.

In the case of test Nos. 17 and 19, although alloys C and E each have a chemical composition almost equivalent to that of alloy 7 used in test No. 7 except that the Nd content is out of the range defined in the present invention, all of the creep rupture time, the creep rupture ductility, and the reduction of area at rupture in the tensile test at very low strain rate (that is, effects of preventing SR cracks) are poor.

In the case of test No. 20, although alloy F has a chemical composition almost equivalent to that of alloy 2 used in test No. 2 except that the O content is out of the range defined in the present invention, all of the creep rupture time, the creep rupture ductility, and the reduction of area at rupture in the tensile test at very low strain rate (that is, effects of preventing SR cracks) are poor.

In the case of test No. 21, although alloy G has a chemical composition almost equivalent to that of alloy 7 used in test No. 7 except that the O content is out of the range defined in the present invention, all of the creep rupture time, the creep rupture ductility, and the reduction of area at rupture in the tensile test at very low strain rate (that is, effects of preventing SR cracks) are poor.

Industrial Applicability

The Ni-based heat resistant alloy of the present invention is an alloy in which the dramatic improvement in ductility after long-term use at high temperatures can be achieved, and the SR cracks that pose a problem in repair welding and the like can be avoided. Therefore, this Ni-based heat resistant alloy can be used suitably as a pipe material, a thick plate for parts having heat resistance and pressure resistance, a rod material, a forging, and the like in power generating boilers, chemical industry plants, and the like.

The invention claimed is:

1. A Ni-based heat resistant alloy consisting, in mass percent, of C: 0.15% or less, Si: 2% or less, Mn: 3% or less, P: 0.03% or less, S: 0.01% or less, Cr: 15% or more and less than 28%, Mo: 3 to 15%, Co: more than 5% and not more than 25%, Al: 0.2 to 2%, Ti: 0.2% to 3%, Nd: f1 to 0.08%, and O: 0.4Nd or less, the balance being Ni and impurities, wherein the f1 refers to the following formula, and in the formula, d denotes an average grain size: 83 μm or more, and each symbol of an element denotes the content in mass % of that element, and likewise, Nd in 0.4Nd denotes the content in mass % of Nd, $$f1=1.7\times10^{-5}d+0.05\{(Al/26.98)+(Ti/47.88)\}.$$

2. A Ni-based heat resistant alloy consisting, in mass percent, of C: 0.15% or less, Si: 2% or less, Mn: 3% or less, P: 0.03% or less, S: 0.01% or less, Cr: 15% or more and less than 28%, Mo: 3 to 15%, Co: more than 5% and not more than 25%, Al: 0.2 to 2%, Ti: 0.2% to 3%, Nd: f2 to 0.08%, and O: 0.4Nd or less, and at least one selected from the group consisting of Nb: 3.0% or less and W: 4% or less, the balance being Ni and impurities, wherein Mo+(W/2) is limited to 15% or less and the f2 refers to the following formula, and in the formula, d denotes an average grain size: 83 μm or more, and each symbol of an element denotes the content in mass % of that element, and likewise, each symbol of an element in 0.4Nd and Mo+(W/2) also denotes the content in mass % of that element, $$f2=1.7\times10^{-5}d+0.05\{(Al/26.98)+(Ti/47.88)+(Nb/92.91)\}.$$

3. A Ni-based heat resistant alloy consisting, in mass percent, of C: 0.15% or less, Si: 2% or less, Mn: 3% or less, P: 0.03% or less, S: 0.01% or less, Cr: 15% or more and less than 28%, Mo: 3 to 15%, Co: more than 5% and not more than 25%, Al: 0.2 to 2%, Ti: 0.2% to 3%, Nd: f1 to 0.08%, O: 0.4Nd or less, and at least one selected from the group consisting of:

B: 0.01% or less, Zr: 0.2% or less, and Hf: 1% or less,

Mg: 0.05% or less, Ca: 0.05% or less, Y: 0.5% or less, La: 0.5% or less, and Ce: 0.5% or less, Ta: 8% or less, and Re: 8% or less, and, the balance being Ni and impurities, wherein the f1 refers to the following formula, and in the formula, d denotes an average grain size: 83 μm or more, and each symbol of an element denotes the content in mass % of that element, and likewise, Nd in 0.4Nd denotes the content in mass % of Nd, $$f1=1.7\times10^{-5}d+0.05\{(Al/26.98)+(Ti/47.88)\}.$$

4. A Ni-based heat resistant alloy consisting, in mass percent, of C: 0.15% or less, Si: 2% or less, Mn: 3% or less, P: 0.03% or less, S: 0.01% or less, Cr: 15% or more and less than 28%, Mo: 3 to 15%, Co: more than 5% and not more than 25%, Al: 0.2 to 2%, Ti: 0.2% to 3%, Nd: f2 to 0.08%, O: 0.4Nd or less, and at least one selected from the group consisting of Nb: 3.0% or less and W: 4% or less, and at least one selected from the group consisting of:

B: 0.01% or less, Zr: 0.2% or less, and Hf: 1% or less,

Mg: 0.05% or less, Ca: 0.05% or less, Y: 0.5% or less, La: 0.5% or less, and Ce: 0.5% or less, Ta: 8% or less, and Re: 8% or less, the balance being Ni and impurities, wherein Mo+(W//2) is limited to 15% or less and the f2 refers to the following formula, and in the formula, d denotes an average grain size: 83 μm or more, and each symbol of an element denotes the content in mass % of that element, and likewise, each symbol of an element in 0.4Nd and Mo+(W/2) also denotes the content in mass % of that element, $$f2=1.7\times10^{-5}d+0.05\{(Al/26.98)+(Ti/47.88)+(Nb/92.91)\}.$$

* * * * *